United States Patent [19]

Bittmann et al.

[11] Patent Number: 4,903,435

[45] Date of Patent: Feb. 27, 1990

[54] DEVICE FOR MOTORIZED OPENING AND CLOSING OF PIVOTABLE BODY PANELS OF MOTOR VEHICLES

[75] Inventors: Werner Bittmann, Ruesselsheim; Gerhard Getrost, Gross-Gerau, both of Fed. Rep. of Germany

[73] Assignee: General Motors Corporation, Detroit, Mich.

[21] Appl. No.: 285,986

[22] Filed: Dec. 19, 1988

[30] Foreign Application Priority Data

Dec. 24, 1987 [DE] Fed. Rep. of Germany ..... 3744083

[51] Int. Cl.[4] ..... E05F 15/04

[52] U.S. Cl. ..... 49/340; 49/347

[58] Field of Search ..... 49/340, 346, 339, 139, 49/140, 344, 347; 296/146

[56] References Cited

U.S. PATENT DOCUMENTS

| | | | |
|---|---|---|---|
| 1,954,739 | 4/1934 | Lyons | 49/344 X |
| 3,022,108 | 2/1962 | Cooley | 49/340 X |
| 3,217,366 | 11/1965 | Wenger | 49/339 X |
| 3,713,472 | 1/1973 | Dozois | 49/340 X |
| 3,747,271 | 7/1973 | Adamski | 49/340 |

*Primary Examiner*—Philip C. Kannan

*Attorney, Agent, or Firm*—William A. Schuetz

[57] ABSTRACT

A device for motorized opening and closing of pivotable body panels of motor vehicles, especially the rear trunk lid or rear hatch and/or the hood of automobiles, has a motor-actuated lever system engaging in an articulated manner, on the one hand, with the body panel, and on the other hand, with the body. The body end of the lever system is articulated at a slide block guided slidingly in a guide track. The slide block is operatively connected to a driver that is secured to a control cable. The ends of the control cable can be wound onto or off a common cable pulley actuated by an electric motor.

17 Claims, 4 Drawing Sheets

Fig. 3
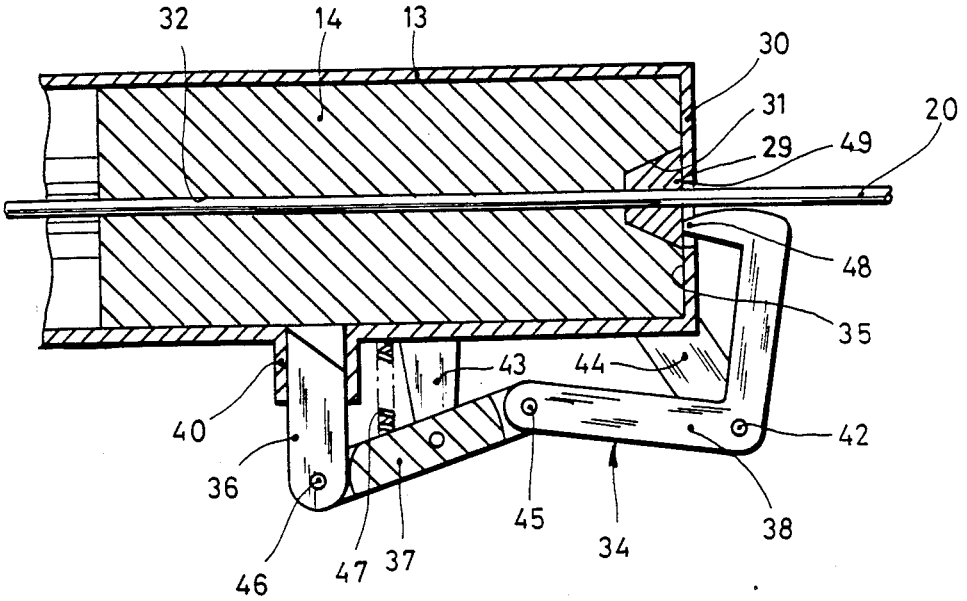
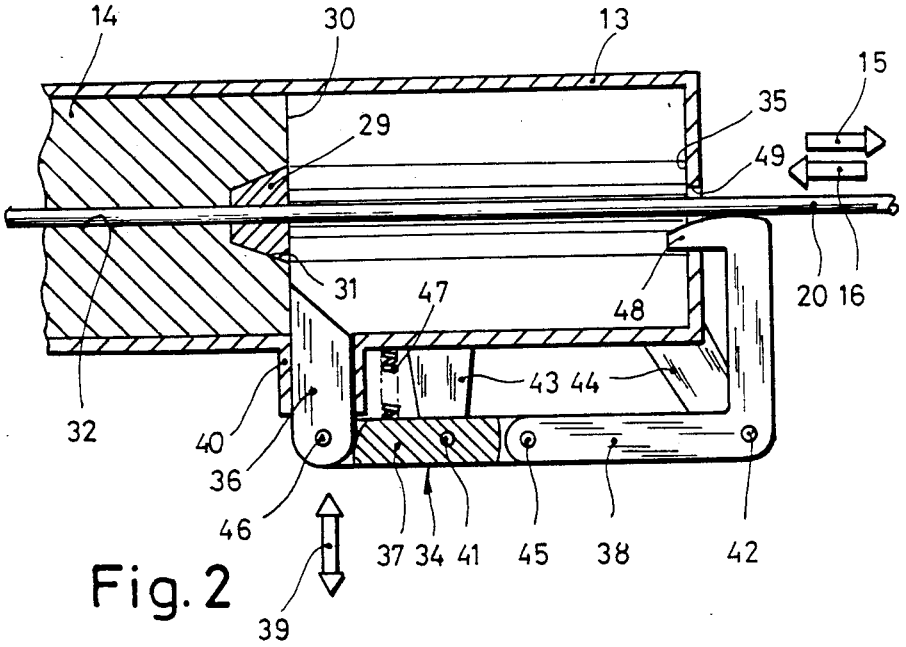
Fig. 2

DEVICE FOR MOTORIZED OPENING AND CLOSING OF PIVOTABLE BODY PANELS OF MOTOR VEHICLES

The invention pertains to a device for motorized opening and closing of pivotable body panels of motor vehicles, especially the trunk lid or rear hatch and/or the hood of automobiles, with a motor-actuated lever system engaging in an articulated manner, on the one hand, with the body panel, and on the other hand, with the body.

Motorized actuation of body panels on vehicles, e.g., motor vehicles, is known in principle. The body panels actuated in this manner are in most cases the vehicle doors. The idea in question is primarily applied, for understandable reasons, in buses, commercial vehicles or similar transport vehicles, but less often in automobiles. As a rule, in known devices of the type in question, the vehicle door is hinged parallel to the side of the vehicle in the open position.

For example, No. DE 35 37 136 A1 discloses a device with which a vehicle door can be electrically moved into the open or closed position. The driving force of the electric motor, a permanently excited low-voltage direct-current motor, is transferred through an angled gear drive to the door being actuated. The known device is intended for bus doors. It is not suitable for the actuation of trunk lids, rear hatches or hoods on automobiles.

Published PCT Application No. WO 79/003 03 (International File No. PCT/DE 78/00035) furthermore discloses a swinging vehicle door in which a guide drive controlling the movement of the swinging vehicle door is provided, by means of which the door is supported on the vehicle and which is configured in the manner of an equivalent mechanism. Simply because of the complexity and large space requirement of the drive, this known device for motorized door actuation is also unsuitable for actuating the above-mentioned body panels on automobiles.

A device for supporting as well as opening and closing vehicle doors is also disclosed by No. DE-OS 23 30 900. This again, as already mentioned, is a so-called externally pivoted sliding door that would probably be primarily designed for large-capacity vehicles such as buses. This known device is therefore also unsuitable for use on pivotable trunk lids, rear hatches or hoods of automobiles, since in these body panels there is generally, because of the construction of automobiles, no possibility for parallel displacement of the body panel along the outer contours of the body.

The purpose of the present invention is to create, with simple and cost-saving means, a device of the type initially described which is especially suitable for actuation of the trunk lid, rear hatch or hood of automobiles, and which also makes it possible for physically handicapped persons to actuate the body panels in question automatically, i.e., without any manual exertion.

According to the invention, the purpose is fulfilled in a device of the type initially described, by the fact that the end of the lever system on the body side is linked to a slide block guided slidingly in a guide track, and that the slide block is operatively connected to a driver which is attached to a control cable, and that the ends of the control cable can be wound onto and off a common cable pulley actuated by an electric motor.

The device according to the invention is characterized by a technically uncomplicated structure and method of operation and is designed in a space saving manner, so that it can easily be installed to the side of the body panel being pivoted, e.g., on the adjacent side of the body. There is no reduction in the dimensions of the trunk or of the space under the hood, usually provided for the vehicle's engine. Since no hydraulic or pneumatic parts at all are present in the device according to the invention, the device according to the invention operates regardless of the prevailing outside temperature.

The invention will be illustrated and explained in more detail by means of examples of embodiments, which are presented in the drawing and will be described detail below. In the drawings, FIG. 1 schematically shows the general structure and method of operation of the device according to the invention, with reference to a side view of a pivotable body panel of a motor vehicle;

FIGS. 2 and 3 show the detail designated Z in FIG. 1, enlarged as compared to FIG. 1;

Figure 1:
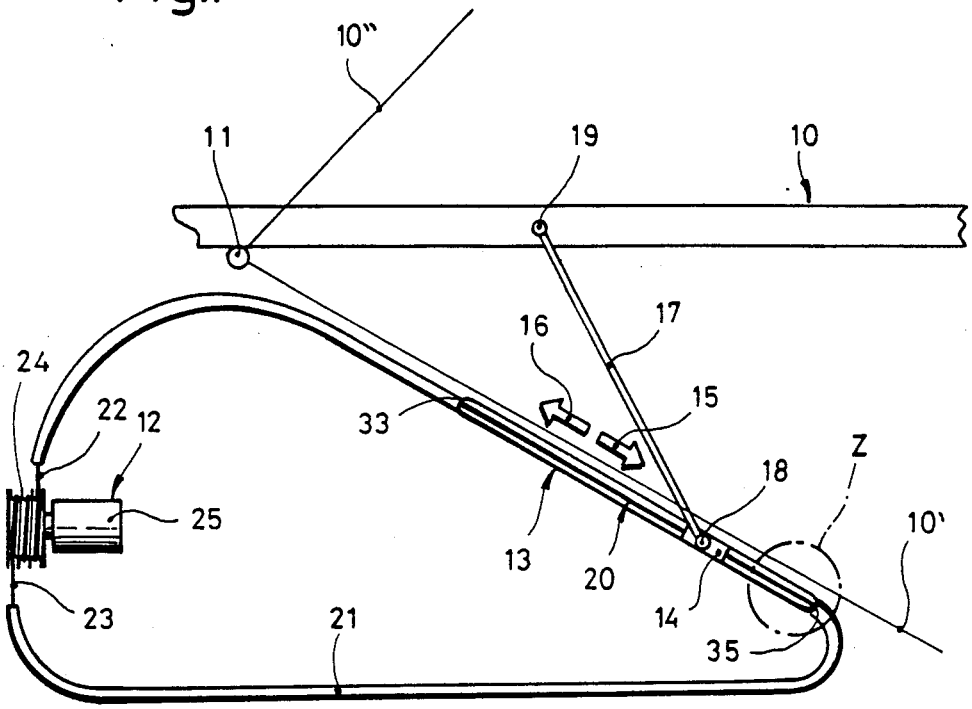

In FIG. 1, 10 indicates a pivotable body panel, for example, the rear hatch of an automobile. This can also, however, be a trunk lid or a hood, for example, the engine hood. The body panel 10 is pivotably mounted at 11 onto the body (not shown in greater detail) of the vehicle in question about an axis running perpendicular to the plane of the drawing. The position of the body panel 10 shown in bold lines in FIG. 1 is a half-open position. The completely open and completely closed end positions are each indicated by fine lines and labeled 10' and 10''. The pivotable body panel 10 is actuated, i.e., opened and closed, by means of a device that can be actuated by an electric motor drive designated as a whole as 12. An essential part of the device is a linear guide track 13, configured as a closed guide rail (see also especially FIGS. 2 and 3), in which a slide block 14 is placed so as to slide in the directions indicated by arrows 15, 16. An actuation rod 17, also linear in configuration, engages with the slide block 14 in an articulated manner. The articulation in question is designated 18. At its upper end, the actuation rod 17 is linked at 19 to the pivotable body panel 10.

The slide block 14 is moved in the direction of arrows 16 or 15 by means of a control cable (or Bowden cable) which is labeled 20 and is guided in a closed loop 21. The configuration of the closed loop 21, however, is in no way confined to the form shown in FIG. 1, which was selected purely for illustrative purposes. Rather, the closed loop 21 is to be adapted in practice, in a simple manner, to the physical circumstances on the vehicle body in question (see, for example, FIGS. 6–9). The two ends of the control cable 20, labeled 22 and 23, run on a common cable pulley 24, which is a component of the electric motor drive already mentioned above, labeled 12. The cable pulley 24 is driven by an electric motor 25 which can rotate in both directions by reversing the polarity.

Figure 5:
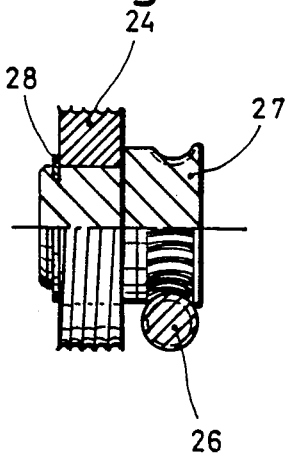
FIG. 5 shows a section along line 5—5 in FIG. 4.
Figure 4:
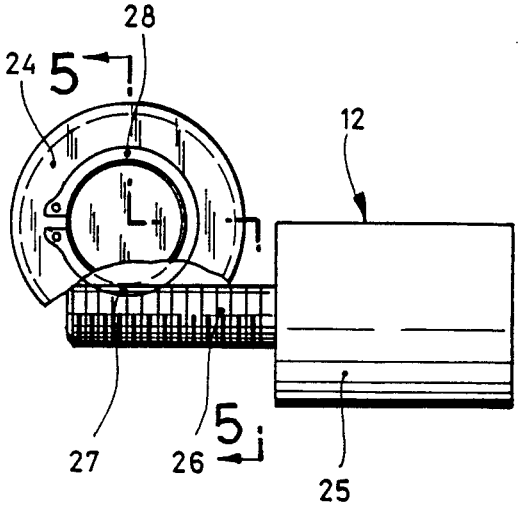
FIG. 4 shows an embodiment of an electric motor drive for a device, e.g., according to FIG. 1.

FIGS. 4 and 5 show, in detail, a possible embodiment of such an electric motor drive 12, in which 26 designates the extended rotor shaft of the electric motor 25, which is also configured as a worm shaft. The worm shaft 26 engages with a worm wheel 27 which is located coaxially with the cable pulley 24 and is nonrotatably secured thereto. The cable pulley 24 is retained axially on the worm wheel 27 by a snap ring 28. By means of the worm drive 26, 27, the rotation speed of the electric motor 25 is correspondingly highly reduced, so that the cable pulley 24 rotates considerably more slowly than the electric motor 25. In addition, the worm drive 26, 27 is designed so that it is self-locking.

Since, as FIG. 1 indicates, the two articulation points 18, 19 of the actuation rod 17 form, together with the articulation 11 of the pivotable body panel 10, an articulation triangle, it is possible, by displacing the articulation point 18 in the direction of arrow 15 or 16, to vary the pivot position of the body panel 10 between its two end positions 10' and 10''. The actuation rod 17 engages with the slide block 14 by means of its articulation 18. As a result, the above-mentioned displacement of the articulation point 18 can be effected by correspondingly displacing the slide block 14 along the guide track 13. The slide block 14 is actuated by the control cable 20—as is shown in detail in FIGS. 2 and 3—by means of a driver 29 secured to the control cable 20, said driver being troncoconical in shape. The driver 29 engages in a correspondingly troncoconical recess 31, formed into the end surface 30 of the slide block 14. If the control cable 20 is now actuated by the electric motor drive 12 in the direction of arrow 16, the driver 29 produces a corresponding movement of the slider block 14 and of the articulation point 18 in the direction of arrow 16. Because force is transferred by the actuation rod 17, the opening angle of the pivotable body panel 10 increases. As FIGS. 2 and 3 indicate, the control cable 20 passes through the slide block 14 in a continuous central hole 32.

The length of the guide track or rail 13 is dimensioned so that the pivotable body panel 10 can reach its maximum opening position 10'' when the slide block 14, as it moves in the direction of arrow 16, has reached the upper end of the guide rail 13, designated 33. At this point is located a limit switch (not shown), which is actuated by the slider block 14. This shuts off the electric motor 25, and the motion of the control cable 20 and the parts driven by it—driver 29, slide block 14, actuation rod 17 and body panel 10—comes to a stop.

To initiate the closing process for the pivotable body panel 10, the electric motor 25 must be manually turned on by pressing a button, at which point the rotation direction of the electric motor reverses, and the control cable 20 now unwinds, at its end 22, from the cable pulley 24, while the other end 23 of the control cable 20 is wound onto the cable pulley 24. The control cable 20 now moves in the direction of arrow 15. The slide block 14 also moves in the direction of arrow 15 at a corresponding speed, since it is loaded by corresponding weight components of the pivotable body panel 10 and the actuation rod 17. The tilted arrangement of the guide rail 13 also has a favorable effect for this direction of motion of the slide block 14.

FIG. 2 now shows that when the slide block 14 moves downward in the direction of arrow 15, it is retained by a locking device designated as a whole as 34, before it reaches the lower end 35 of the guide rail 13. The locking device 34 has a locking bolt 36 perpendicular to the directions of motion 15, 16 of the slide block 14, which can be slid into the guide track 13 and can be moved by means of a knuckle joint 37, 38 in the direction of arrow 39. This guides the locking bolt 36 into a connecting sleeve 40 on the guide rail 13. The lever parts 37 and 38 which form the knuckle joint are pivotably mounted at 41 and 42 to pillow blocks 43 and 44 attached to the guide rail 13. The lever parts 37, 38 are pivotedly mounted to one another at 45. The articulation 45 is configured in such a way that the length changes (see FIG. 3), which occur when the lever parts 37, 38 pivot, are compensated for. The lever part 37 is articulated at 46 onto the locking bolt 36. In addition, there engages with the lever part 37 a pretensioned tension spring 47, which keeps the knuckle joint 37, 38 and therefore also the locking bolt 36, in the locking position visible in FIG. 2. The locking bolt 36 is actuated against the force exerted by the spring 47 by the lever part 38, which for this purpose is bent through two right angles. The free end 48 of the lever part 38 projects, through a cutout 49, into the guide rail 13. The lever end 48 is provided so as to connect operatively with the driver 29 secured to the control cable 20. The details of this operation are shown in FIG. 3. After the slide block 14 has been arrested during its downward motion (in the direction of arrow 15) by the locking device 34 in its position visible in FIG. 2, the control cable 20 together with the driver 29 continues to move in the direction of arrow 15, in the process of which the driver 29 moves out of the troncoconical recess 31 which attaches it in an interlocking manner with the slide block 14. Lastly, the driver 29 reaches the end 48 of the lever part 38 and thus moves the knuckle joint 34 into the position seen in FIG. 3. Shortly thereafter, the driver 29 comes into contact with the lower end surface of the guide rail 13 and thereby actuates another limit switch (not shown), as a result of which the electric motor 25 is shut off, and further motion of the control cable 20 is halted. FIG. 3 also indicates that in this position of the knuckle joint 34, the locking bolt 36 moves out of the interior of the guide rail 13, and the locking device 34 is thus unlocked. As a result, the slide block 14 can now continue its downward motion (in the direction of arrow 15), interrupted at the position in FIG. 2. This "waiting position" of the slide block 14 shown in FIG. 2 corresponds to an opening of about 200 to 300 mm of the pivotable body panel 10. This opening is selected so that the body panel 10, after the locking device 34 has been unlocked (FIG. 3), can automatically fall into the lock by its own weight. In the process, the slide block 14 moves into its lowest end position visible in FIG. 3, in which it is in contact with the end surface 35 of the guide rail 13.

If the pivotable body panel 10 is now opened again, it must first be manually unlocked and lifted far enough so that the fork latch (lock) is separated from the locking bolt or shackle (not shown). An electrical impulse can now be given, by means of a corresponding switch actuation, to the electric motor, whereupon the latter executes the above-mentioned automatic opening process (control cable actuation in the direction of arrow 16).

It should also be mentioned that when the electric motor 25 is shut off, the pivotable body panel 10 is retained in any desired open position due to the self-locking of the worm drive 26, 27 (see FIGS. 4 and 5).

Figure 9:
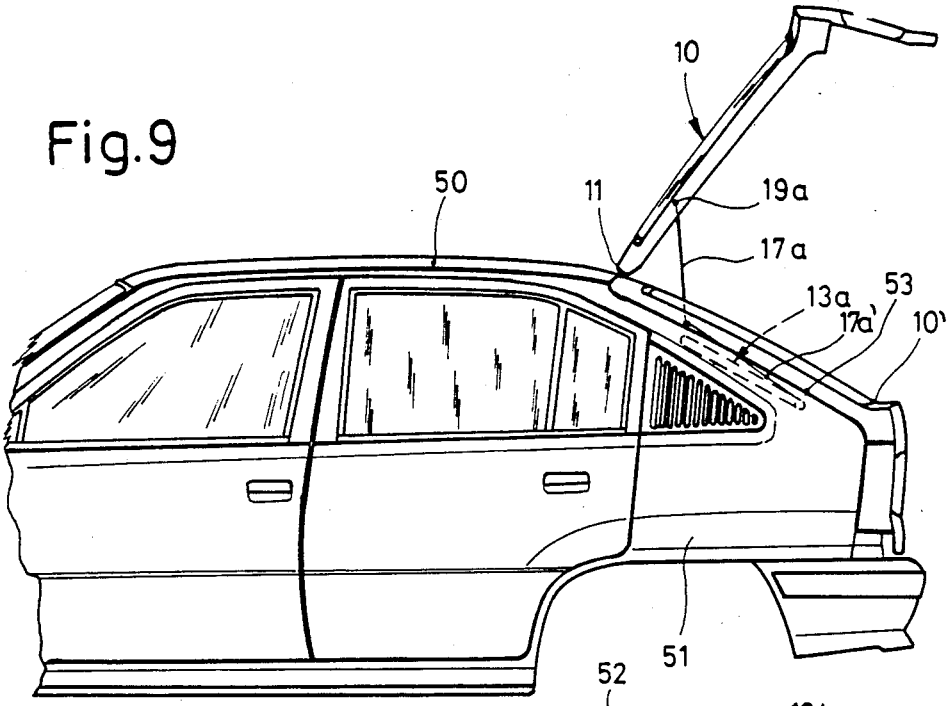
FIG. 9 shows the automobile body according to FIG. 6 in side view.
Figure 6:
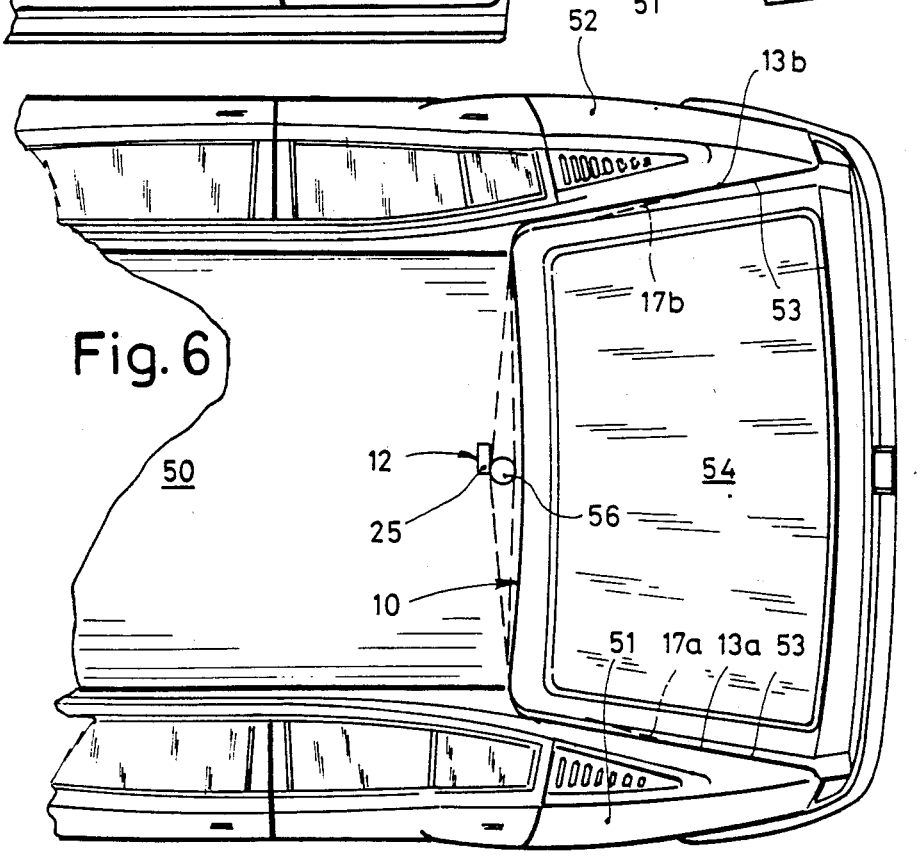
FIG. 6 shows the rear portion of an automobile body, with the rear hatch in the closed position, from above.
Figure 7:
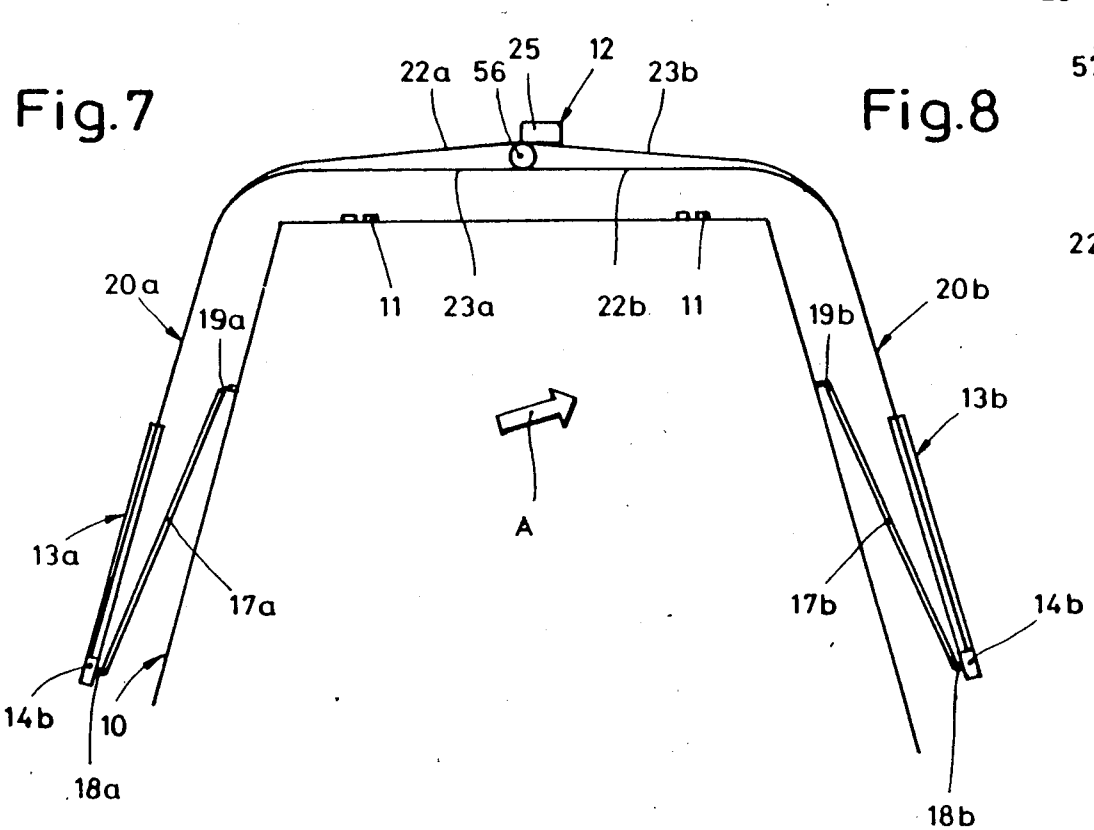
FIG. 7 shows an embodiment of an actuation device for the rear hatch according to FIG. 6 in a schematic presentation according to FIG. 6.

FIGS. 6–9 now show the practical application of an actuation device of the type described above, using the example of a pivotable rear hatch of an automobile. The rear hatch, labeled 10, is pivotedly articulated at 11 by means of a corresponding hinge on the vehicle roof 50. FIG. 9 shows both the closed position—designated 10'—and the open position of the rear hatch 10. In the embodiment according to FIGS. 6 and 9 (but see also the schematic functional diagram in FIGS. 7 and 8), two guide tracks 13*a* and 13*b* are provided, which are located on the body side walls 51 and 52 next to the edge 53 of the trunk 54 and running parallel to the edge 53. The obliqueness of the guide tracks 13*a* and 13*b* thus corresponds to the slope of the rear end of the body (see FIG. 9). Corresponding to the two guide tracks 13*a* and 13*b*, two actuation rods are also provided, labeled 17*a* and 17*b*. The actuation rods 17*a*, 17*b* engage at one end with the sliding blocks 14*a* and 14*b* and at the other end—at 19*a* and 19*b*—at the sides of the rear hatch 10. The articulation points on the sliding blocks 14*a* and 14*b* are labeled 18*a* and 18*b*. FIGS. 6 and 7 illustrate the fact that the actuation rods 17*a*, 17*b* are each placed so they slope from the outside towards the inside, so that when the rear hatch 10 closes, they can pivot into the interior of the trunk 54. They are therefore not visible from the outside when the rear hatch 10 is closed.

Figure 8:
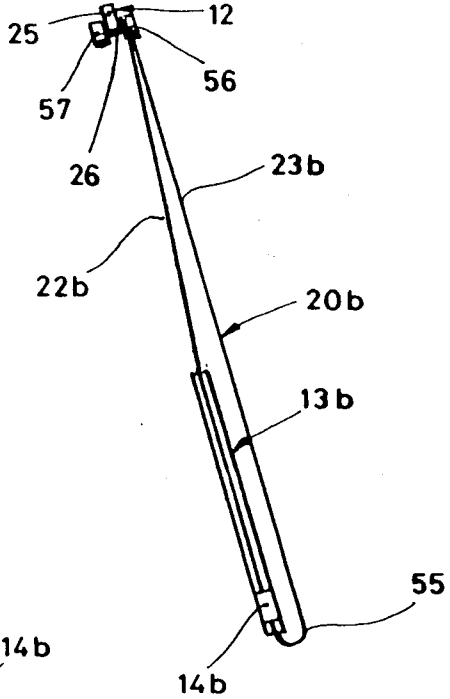
FIG. 8 shows a partial view of the object of FIG. 7 seen in the direction of arrow A.

FIGS. 7 and 8 show that a separate control cable 20*a* and 20*b* is provided to drive each of the two actuation rods 17*a*, 17*b*. As FIG. 8, in particular, illustrates, each of the two identically configured control cables 20*a* and 20*b* consists of two essentially parallel cable lines 22*a*, 23*a* and 22*b*, 23*b*. The two cable lines result from a corresponding reversal of the control cable, e.g., 20*b*, at 55. FIG. 8 illustrates that the cable line 22*b* is provided to actuate the rear hatch 10 in the opening direction, and the other cable line 23*b* to actuate the rear hatch 10 in the closing direction. The same applies correspondingly to the other cable line 20*a*. FIG. 7, furthermore, illustrates that the two cable lines 20*a* and 20*b* are guided along the contours of the rear hatch 10 and essentially parallel thereto.

FIGS. 6, 7 and 8 further indicate that a common drive 12 is provided to actuate the two cable lines 20*a*, 20*b*, consisting of an electric motor 25 with a worm drive 26 and cable pulleys 56, 57. The drive 12 is placed on the center line of the vehicle on the inside of the roof 50, next to the pivot axis 11 of the rear hatch 10. The cable pulley consists of two partial pulleys 56, 57 placed on a common shaft, with the partial roller designated 56 being associated with the cable line 23*b* responsible for the closing motion and with the cable line 22*b* responsible for the opening motion of the rear hatch 10.

SUMMARY

A device for motorized opening and closing of pivotable body panels of motor vehicles, especially the rear trunk lid or rear hatch and/or the hood of automobiles, has a motor-actuated lever system engaging in an articulated manner, on the one hand, with the body panel, and on the other hand, with the body. The body end of the lever system is articulated at a slide block guided slidingly in a guide track. The slide block is operatively connected to a driver that is secured to a control cable. The ends of the control cable can be wound onto or off a common cable pulley actuated by an electric motor.

By means of the features described above, it has been possible to create a fully automatic opening and closing system for pivotable body panels of motor vehicles, which operates independent of temperature, and in particular, is tailored to the requirements of physically handicapped persons. The pivotable body panel, e.g., the rear hatch of an automobile, is automatically opened, after being unlocked, by the said control cable. By adjusting a rotary knob preselection control, it can be brought to any desired pivot position and stopped in this pivot position. Manual lifting or securing of the body panel is eliminated.

The embodiment of the invention in which an exclusive property or privilege is claimed are defined as follows:

1. In an automotive vehicle having vehicle body structure and a body closure panel pivotally connected to the body structure for movement between open and closed positions, and a reversible power operated lever system operatively connected with the body structure and said body panel for effecting movement of said body panel between its positions, the improvement being that said lever system comprises a stationary guide track supported by said body structure, a slide block slidably and guidably supported by said guide track for movement in opposite closure panel opening and closure panel closing directions, a lever having one end pivotally connected to said slide block and its other end pivotally connected to said body panel and a reversible power operated drive means including a control cable and a driver attached to the cable, said driver being engageable with said slide block to positively move the same in said closure panel opening direction to effect opening movement of said body panel when the drive means is energized to move the cable in said closure panel opening direction, said driver being releasable from said slide block when the drive means is energized to move the cable in said closure panel closing direction, said slide block moving in the closure panel closing direction to effect sloping movement of said body panel due to the weight of said body panel and lever as said cable and driver are moved in said closure panel closing direction.

2. In an automotive vehicle, as defined in claim 1, and in which said guide track extends in a direction which is substantially parallel to the plane of the body panel when the latter is in its closed position.

3. In an automotive vehicle, as defined in claim 2, and in which said body closure panel is pivotally connected to said body structure via hinge means for movement about a generally horizontal axis, wherein guide track is linear and extends in a direction toward said horizontal axis of said hinge means, and in which said lever is pivotally connected to said body closure panel at a location spaced from said horizontal axis of said hinge means whereby said closure panel, lever and guide track provide a three bar linkage arrangement.

4. In an automotive vehicle, as defined in claim 3, and wherein said lever is connected to a lateral side of said closure panel and said guide track and drive means are located laterally of said closure panel.

5. In an automotive vehicle, as defined in claim 3, and wherein said body closure panel slopes downwardly when in its closed position proceeding from said hinge means towards its other end and wherein said linear guide track also slopes downwardly proceeding from its end closest to said hinge means toward its other end.

6. In an automotive vehicle, as defined in claim 5, and wherein said body closure panel is a rear door for a rear compartment for said vehicle and wherein the guide track is supported by the body structure of the vehicle adjacent said compartment at its side and wherein said lever is pivotally connected to said rear door at its side and said body structure so that it is inclined inwardly whereby it is pivotable into and located within said compartment when the rear door is in its closed position.

7. In an automotive vehicle, as defined in claim 6, and wherein said reversible power operated means also includes an electric motor, worm gear unit and pulley which are located at a central location of the vehicle adjacent its roof, and wherein the control cable is guided along the contours of the body structure adjacent the rear door and essentially parallel thereto.

8. In an automotive vehicle, as defined in claim 6, and wherein two guide tracks, slide blocks and levers of identical construction are located adjacent the rear door on opposite sides thereof, and wherein separate closed-loop cables are connected to a driver for each slide block.

9. In an automotive vehicle, as defined in claim 8, and wherein a common drive means consisting of a reversible electric motor, worm gear unit and pulley is provided for the two control cables.

10. In an automotive vehicle, as defined in claim 9, and in which the pulley consists of two partial pulleys mounted on a common axis, and wherein one partial pulley is associated with one of the closed loop cables and the other partial pulley is associated with the other closed loop cable.

11. In an automotive vehicle, as defined in claim 1, and wherein said reversible power operated drive means comprises a reversible electric motor, a pulley and a self-locking worm gear unit interposed between and drivingly connected with said electric motor and said pulley, said self-locking worm gear unit being operable to hold said body closure panel in any open position to which it is moved.

12. In an automotive vehicle, as defined in claim 11, and wherein said control cable is guided in a closed loop which starts from and returns to said pulley, said control cable extending through said guide track and slide block and connected to said driver.

13. In an automotive vehicle, as defined in claim 1, and wherein said driver is frustoconical and cooperates with a corresponding frustoconical recess in the end face of the slide block facing towards the direction of closing.

14. In an automotive vehicle as defined in claim 1 and further including a locking device for automatically locking said slide block against further movement in said closure panel closing direction during the latter part of its movement in this direction to hold said body closure panel in a slightly open position and with said driver being releasable from said slide block as it and the cable continue to move in said closure panel closing direction for a limited distance until said driver reaches an end position, said locking device being operable in response to said driver reaching its end position to release said slide block for further movement in said closure panel closing direction whereby said closure panel falls automatically to its closed position due to its own weight.

15. In an automotive vehicle, as defined in claim 14, and wherein said locking device includes a locking bolt which extends through an opening in said guide track and which is movable relative thereto in directions which are transverse to the directions of movement of the slide block, a spring means for biasing said locking bolt toward a locking position in which it is disposed within the guide track so that it is engageable by the slide block when the latter moves in its closure panel closing direction, and a pivotable lever means operatively connected to said locking bolt and having an end portion disposed within the guide track, said end portion being engaged by said driver when the latter approaches said end position to cause said lever means to pivot and move said locking bolt in opposition to the biasing force of said spring means to an unlocked position in which it is not engaged with said slide block.

16. In an automotive vehicle, as defined in claim 15, and wherein said lever means is toggle lever means.

17. In an automotive vehicle, as defined in claim 16, and wherein said toggle lever means comprises a first lever pivotally supported intermediate its ends by said guide track and a second lever pivotally supported intermediate its ends by said guide track, said first lever being pivotally connected at one end to said locking bolt and at its other end to one end of said second lever, said second lever having its other end free and disposed within said guide track so that it is engageable by said driver.

* * * * *